US006247214B1

(12) United States Patent
Hyde

(10) Patent No.: US 6,247,214 B1
(45) Date of Patent: Jun. 19, 2001

(54) HOLDING DEVICE FOR FASTENING LACES

(76) Inventor: Elias John Hyde, 6 Constance Street, Darlington, Western Australia (AU)

( * ) Notice: Subject to any disclaimer, the term of this patent is extended or adjusted under 35 U.S.C. 154(b) by 0 days.

(21) Appl. No.: 09/051,546

(22) PCT Filed: Oct. 7, 1996

(86) PCT No.: PCT/AU96/00627

§ 371 Date: Apr. 7, 1998

§ 102(e) Date: Apr. 7, 1998

(87) PCT Pub. No.: WO97/13423

PCT Pub. Date: Apr. 17, 1997

(30) Foreign Application Priority Data

Oct. 10, 1995 (AU) ..... PN5884
Apr. 12, 1996 (WO) ..... PCT/AU96/00216

(51) Int. Cl.[7] ..... A43C 7/04
(52) U.S. Cl. ..... 24/712.6; 24/712.7
(58) Field of Search ..... 24/712.1–712.8; 36/50.1

(56) References Cited

U.S. PATENT DOCUMENTS

| | | | |
|---|---|---|---|
| 1,624,564 | | 4/1927 | Shetzline, Jr. et al. . |
| 2,911,697 | | 11/1959 | Henderson . |
| 3,108,343 | | 10/1963 | Mo . |
| 3,138,839 | | 6/1964 | Mathes . |
| 3,176,362 | | 4/1965 | Tames . |
| 3,225,402 | | 12/1965 | Altman et al. . |
| 3,290,745 | * | 12/1966 | Maxwell et al. . |
| 3,537,151 | * | 11/1970 | Sobel et al. . |
| 4,805,270 | | 2/1989 | Kimbrough . |
| 5,022,127 | * | 6/1991 | Ang . |

FOREIGN PATENT DOCUMENTS

| | | |
|---|---|---|
| 271364 | 10/1950 | (CH) . |
| 663 136 | 7/1938 | (DE) . |
| 0 079 874 | 5/1983 | (EP) . |
| WO 88/06011 | 8/1988 | (WO) . |
| WO 89/05200 | 6/1989 | (WO) . |
| WO 92/06609 | 4/1992 | (WO) . |

* cited by examiner

*Primary Examiner*—James R. Brittain
(74) *Attorney, Agent, or Firm*—Holland & Hart LLP

(57) ABSTRACT

The invention provides a fastening device for releasably securing two lace ends (3) together. The fastening device comprises a body including first and second members (11, 12) having a passage through which the lace ends can pass. The passage may include aperture means (25). The device also comprises a gripping means associated with the passage for gripping the lace ends in a manner which allows movement of the lace ends through the passage but selectively resists reverse movement. The gripping means are typically defined by the first and second members (11, 12).

32 Claims, 8 Drawing Sheets

HOLDING DEVICE FOR FASTENING LACES

TECHNICAL FIELD

This invention relates to a fastening device for releasably securing two lace ends together.

BACKGROUND OF THE INVENTION

The invention has been devised particularly, although not solely, for releasably fastening together the opposite ends of a shoe lace thereby avoiding the need to tie the shoe lace together using a conventional bow. The invention may have other applications such as where laces are employed in garments and bags.

The two lace ends may be the ends of two separate laces or the opposite ends of a single lace. The term "lace end" is taken to include the free portion of a lace extending beyond that portion of the lace which is in a lacing arrangement.

In the specification, the term "lace" shall be taken to include any cord or string for holding or drawing together.

SUMMARY OF THE INVENTION

In one form the invention resides in a fastening device for releasably securing two lace ends together, comprising a body having a passage through which the lace ends can pass, and gripping means associated with the passage for gripping the lace ends in a manner which allows movement of the lace ends through the passage but selectively resists reverse movement.

Preferably, the fastening device further comprises a holding means for releasably holding the portion of each lace end extending beyond the passage. A loop formation may conveniently be formed in each lace end.

Preferably, the body includes first and second members defining said passage therebetween. Preferably, said passage includes aperture means provided in the first member through which the lace ends can enter the passage, the arrangement being such that in use the lace ends extend in substantially opposite directions within said passage and emerge from the passage at the periphery thereof.

Preferably, said first and second members define the gripping means. In this connection the first and second members are preferably mounted for movement towards and away from each other whereby they can assume an engaging condition in which they engage the lace ends in a manner which allows movement of the lace ends through the passage to emerge from said periphery but prevents movement in the reverse direction and a release condition in which they allow movement of the lace ends in the reverse direction.

Preferably, the gripping means comprises two clamping units each adapted to engage one of the lace ends. For preference, each clamping unit comprises two clamping jaws, one clamping jaw being defined by the first member and the other clamping jaw being defined by the second member whereby the clamping jaws move between said engaging and release conditions with movement of the first and second members towards and away from each other.

Preferably, each clamping unit comprises a clamping portion to assist in preventing movement of the lace ends in a reverse direction when the first and second members are in an engaging condition. The clamping portions are preferably in the form of elongate projections on the first member which are disposed laterally of the aperture means on opposed sides thereof. The clamping portion of each first member presents a clamping edge which cooperates with the corresponding edge of the second member to assist in clamping the respective lace end to inhibit movement of the lace end in a reverse direction.

Preferably, biasing means are provided for urging the first and second members in the direction towards each other thereby to influence the clamping jaws into the engaging condition.

Preferably, the biasing means comprises an elastic band attached to one of the first and second members and releasably attachable to the other of the first and second members whereby when so attached the elastic band resiliently resists movement of the first and second members in the direction away from each other. For preference, said one of the first and second members comprises the second member and the said other of the first or second members comprises the first member. The elastic band is preferably attached to one of the first or second members by being fitted onto said first or second member to extend therearound.

Preferably, said aperture means comprises two apertures each for receiving one of the lace ends.

Preferably, said aperture means are provided centrally within said first member and said clamping units are disposed laterally thereof.

Preferably, said clamping units are disposed adjacent the outer periphery of said passage.

Preferably, said holding means comprises a wedge provided on said second member. For preference, said wedge comprises a pair of inclined faces one of which is defined by said second member.

The two loop formations may be arranged to form a bow.

In another form the invention resides in a fastening device for releasably securing two lace ends together comprising a body having first and second members defining a space therebetween, aperture means provided in the first member and opening onto said space for receiving the lace ends whereby the lace ends can enter. said space through the aperture means and extend in substantially opposite directions to emerge at the outer periphery of said space, gripping means having a gripping condition and a release condition whereby in said gripping condition the gripping means allows movement of the lace ends from said aperture means through said space to emerge therefrom while resisting movement in the reverse direction and wherein in said released condition said gripping means allows movement of the lace ends in said reverse direction.

Preferably, said gripping means are defined by said first and second members.

The gripping means may comprise two clamping units each adapted to engage one of the lace ends.

Preferably, said aperture means is disposed centrally within said first member and said clamping units are disposed laterally of said aperture means to opposed sides thereof.

Preferably, said clamping units are located adjacent the outer periphery of said space.

Preferably, said aperture means comprises a pair of openings in the first member, each adapted to receive one of the lace ends.

Preferably, said fastening device further includes holding means for releasably holding the portions of each lace end extending outwardly from said space to establish a loop formation in the lace end.

With the exception of the biasing means, the components of the fastening device may be formed of integral construction and made of plastics material. In addition, the first and second members of the body may be pivotally connected by means of a film hinge or other suitable connecting means.

BRIEF DESCRIPTION OF THE DRAWINGS

The invention will be better understood by reference to the following description of three embodiments thereof which is directed to a fastening device for releasably securing together the ends of a shoe lace. The description will be made with reference to the accompanying drawings in which.

DESCRIPTION OF PREFERRED EMBODIMENT

Figure 8:
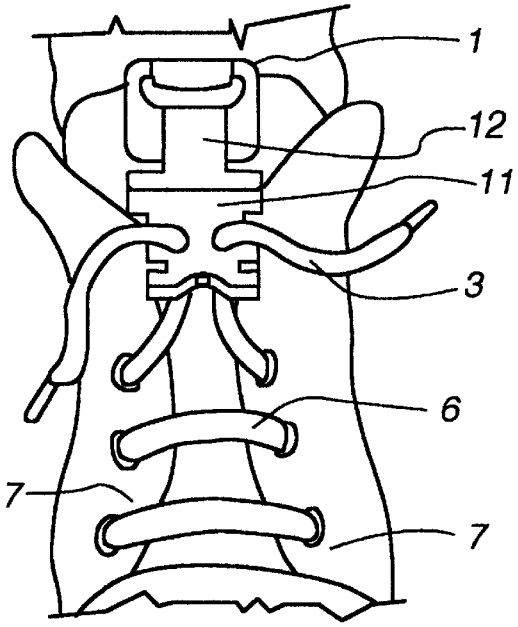
FIG. 8 is a schematic view illustrating the fastening device according to the first embodiment being fitted onto the ends of the shoe lace prior to the first and second members being elastically connected together.

The embodiments are directed to a fastening device 1 adapted to releasably secure together the lace ends 3 of a shoe lace 4 of a shoe 5. The shoe 5 has vamp sections 7 which are laced together by shoe lace 4 having a lacing arrangement 6 with the ends 3 of the shoe lace extending beyond the lacing arrangement. In the embodiments the shoe lace 4 is of the type commonly known as a flat shoe lace but could equally be a round shoe lace.

A fastening device according to the first embodiment, as shown in FIGS. 1 to 13, comprises a first member 11 and a second member 12 both formed integrally of plastics material pivotally connected together by a film hinge 14 for movement towards and away from each other.

Figure 10:
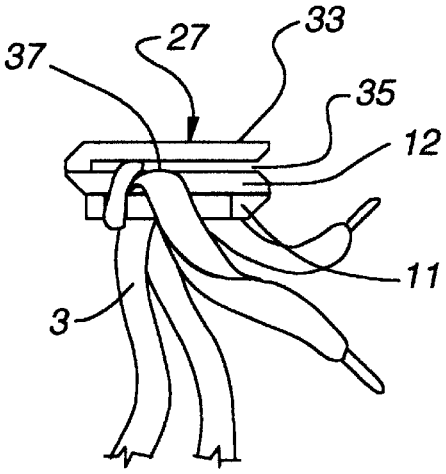
FIG. 10 is a side view illustrating the fastening device according to the first embodiment being fitted onto the ends of the shoe lace with the first and second members elastically connected together.
Figure 5:
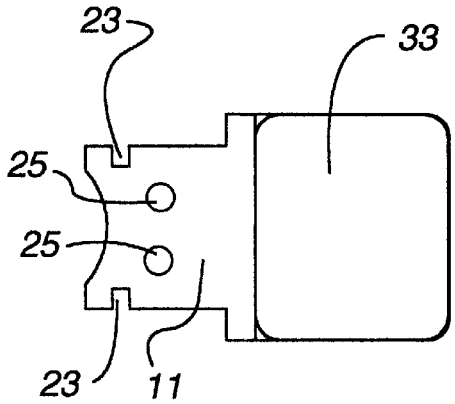
FIG. 5 is a top plan view of the device as shown in FIG. 4.
Figure 9:
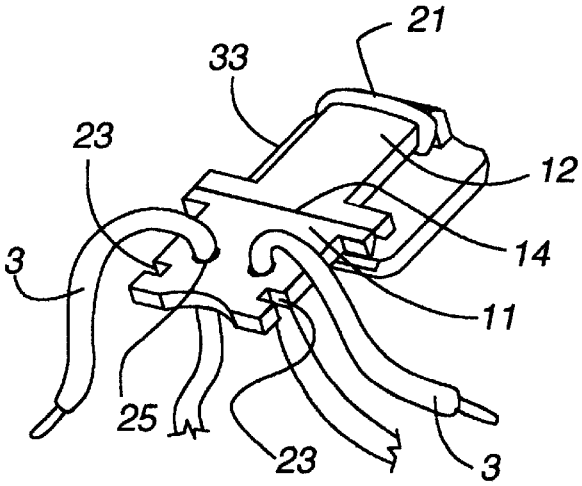
FIG. 9 is a detailed view of FIG. 8.
Figure 7:
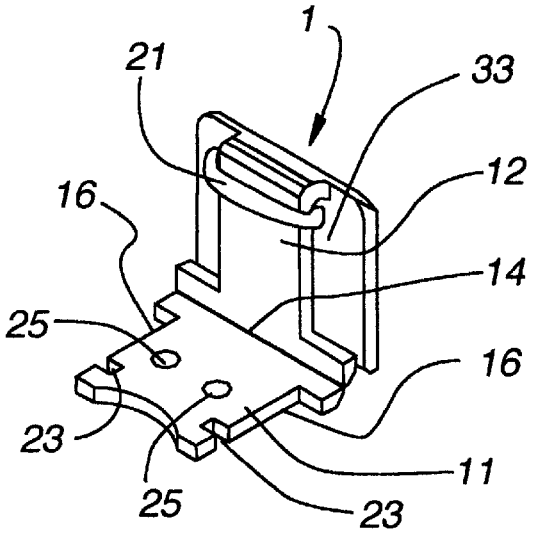
FIG. 7 is a perspective view of the fastening device according to the first embodiment with the first and second members swung apart.
Figure 6:
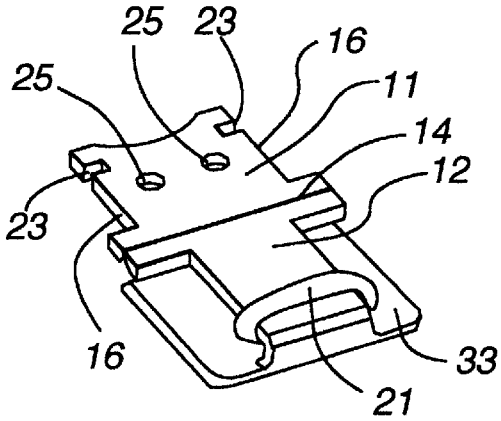
FIG. 6 is a plan view of the fastening device according to the first embodiment with the first and second members swung apart in particular to illustrate the film hinge between the two members.

A biasing means 21 is provided for selectively urging the first and second members 11 and 12 towards each other. The biasing means 21 is in the form of an elastic band which extends around the second member 12 and is adapted to be secured to the first member 11 adjacent the free end thereof. For this purpose, the first member 11 is provided with a groove 23 to receive and locate the elastic band when it is passed around the first member, as best seen in FIGS. 9 and 10 of the drawings. While the elastic band 21 serves to bias the first and second members towards each other, it can be readily detached from the first member so as to allow the second member to swing away from the first member without the biasing effects if required.

The first member 11 is provided with aperture means in the form of two holes 25, each adapted to receive one of the ends of the shoe lace.

Figure 2:
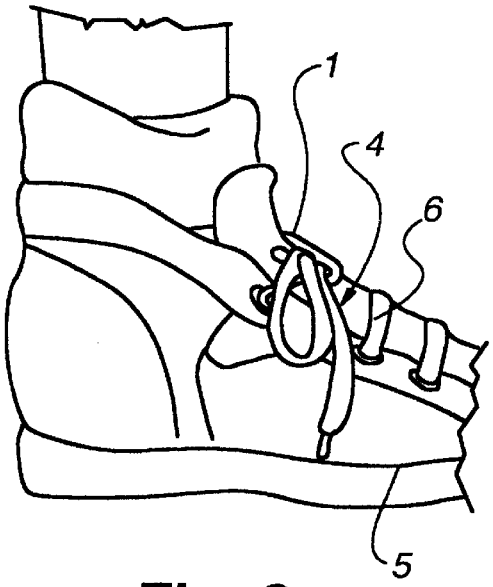
FIG. 2 is a side elevational view of the arrangement shown in FIG. 1.

A holding means 27 is provided on the second member 12 for the purpose of holding each lace end in a loop formation to create the appearance of a bow, as best seen in FIGS. 2 and 10 of the drawings. The holding means comprises an outer member 33 which cooperates with the second member 12 to define a wedge 35 into which the lace ends are inserted. In the embodiment, the second member 12 and the outer member 33 are of integral construction.

Figure 3:
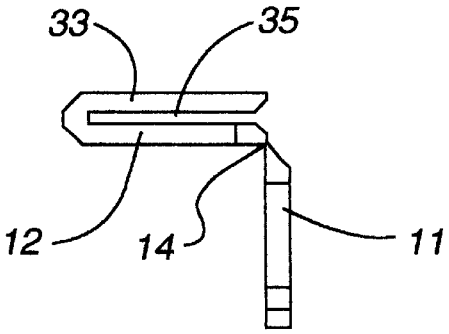
FIG. 3 is a schematic side elevational view of the fastening device according to the first embodiment with the first and second members swung apart.
Figure 4:
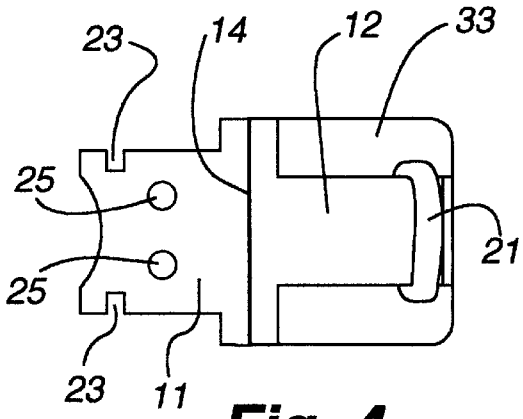
FIG. 4 is a view of the fastening device according to the first embodiment with the first and second members swung apart.

The open end of the wedge is adjacent the hinge 14, as best seen in FIG. 3 of the drawings.

Operation of the fastening device according to the first embodiment will now be described.

The fastening device is initially installed onto the shoe lace by detaching the elastic band 21 from the first member 11 and moving the first and second members apart so as to expose the two holes 25. One lace end 3 is threaded through each hole 25 and the lace ends 3 are then laid in opposite directions, as shown in FIG. 9 of the drawings. It will be noted that the lace ends are not crossed over each. other at the vamp sections, as would normally be done in tying a conventional bow in the shoe lace. The second member is then pivoted towards the first member and the elastic band 21 is engaged with the first member such that it locates on the underside thereof and in the grooves 23.

Figure 12:
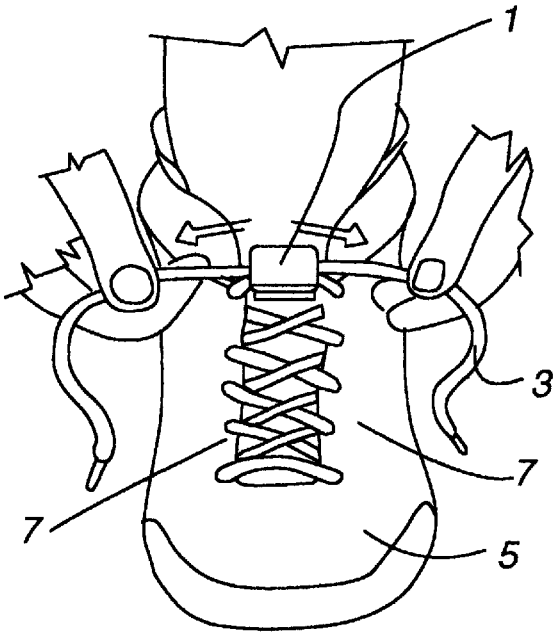
FIGS. 12 and 13 are schematic front elevational views showing the fastening device according to the first embodiment in position on a shoe and securing the ends of the shoe lace together after the first and second members have been elastically connected together.

With this arrangement, the lace ends are accommodated within the space 37 defined between the first and second members 11 and 12 respectively, and emerge from such space in opposite directions as shown in FIGS. 10 and 12. The first and second members to clampingly engage the lace ends such that upon pulling of the lace ends to tighten the shoe lace and so draw the vamp sections of the shoe together, the lace ends can move through the two holes 25 and the space 37. The clamping action of the first and second members 11 and 12 does, however, resist reverse movement of the lace ends which would result in loosening of the shoe lace.

Figure 1:
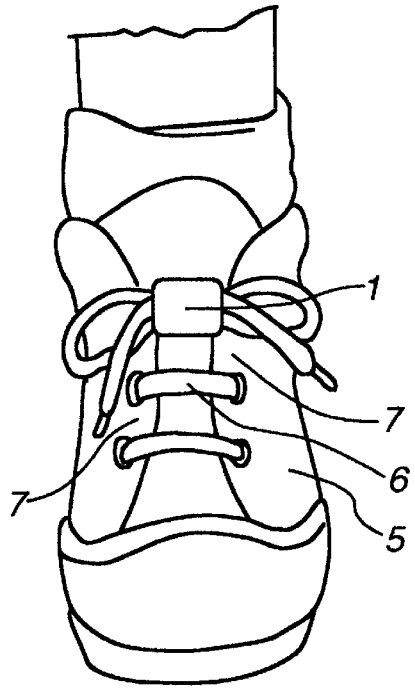
FIG. 1 is a schematic front elevational view showing the fastening device according to the first embodiment in position on a shoe and securing the ends of the shoe lace together in a bow form.
Figure 11:
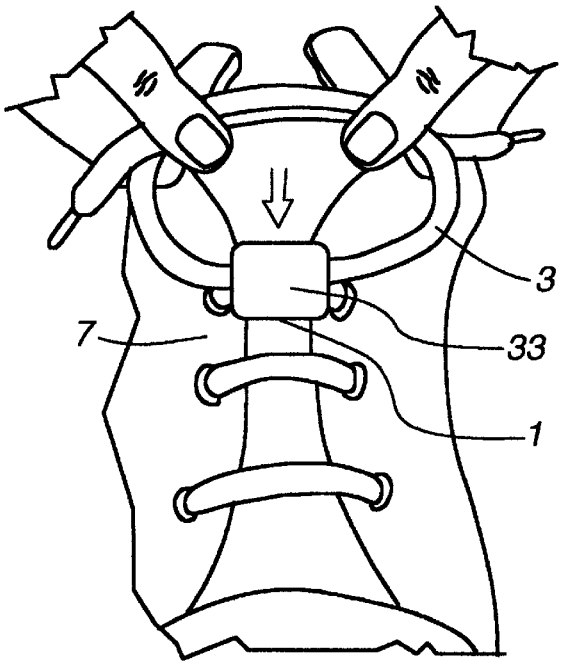
FIG. 11 is a schematic view showing the shoe lace in a tightened condition but prior to the formation of a bow as shown in FIG. 1.

If a bow is required in the lace ends, once the shoe lace has been tightened sufficiently the outer sections of the lace ends 3 are placed one upon the other so as to create a loop formation in each lace end, as shown in FIG. 11. The overlapping sections of the lace ends are then inserted into the wedge 35 which retains them in such position with the result that the two loop formations appear as a bow, as best seen in FIG. 1.

Figure 13:
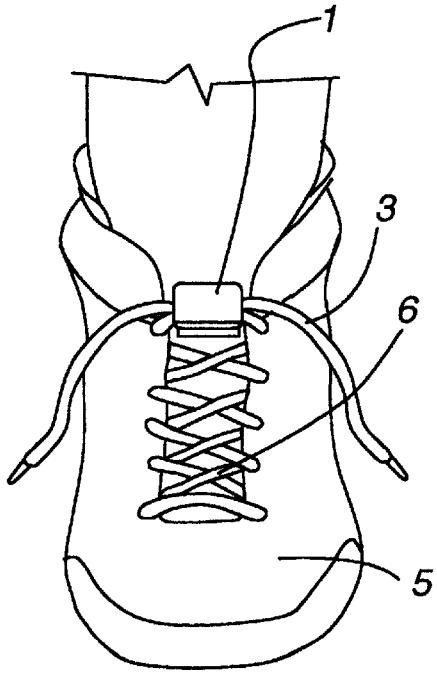
Figure 20:
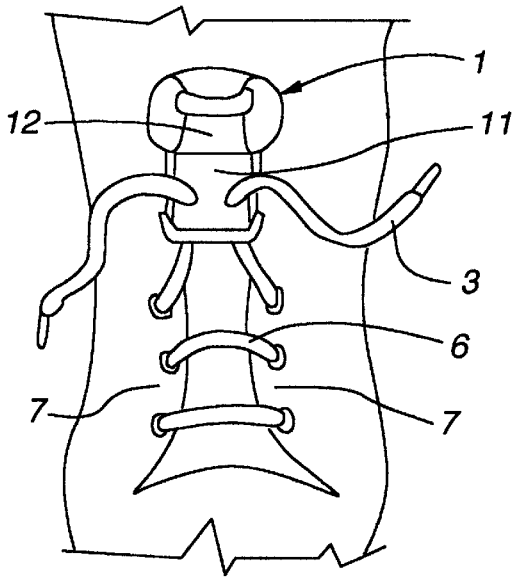
FIG. 20 is a schematic view illustrating the fastening device according to the second embodiment being fitted onto the ends of the shoe lace prior to the first and second members being elastically connected together.
Figure 14:
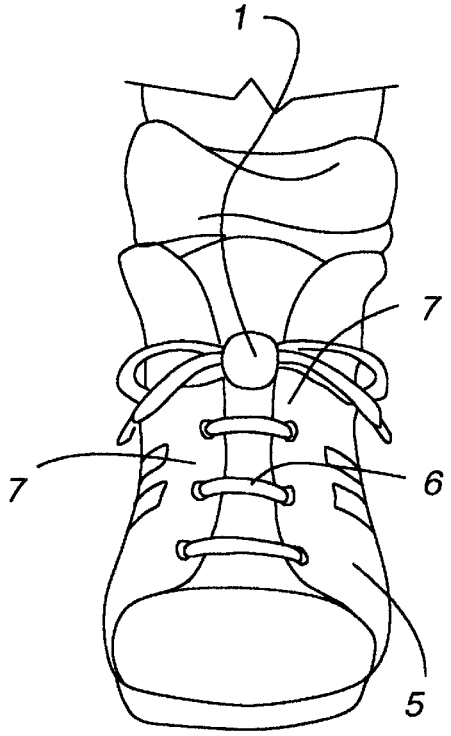
FIG. 14 is a schematic front elevational view showing the fastening device according to the second embodiment in position on a shoe and securing the ends of the shoe lace together.
Figure 24:
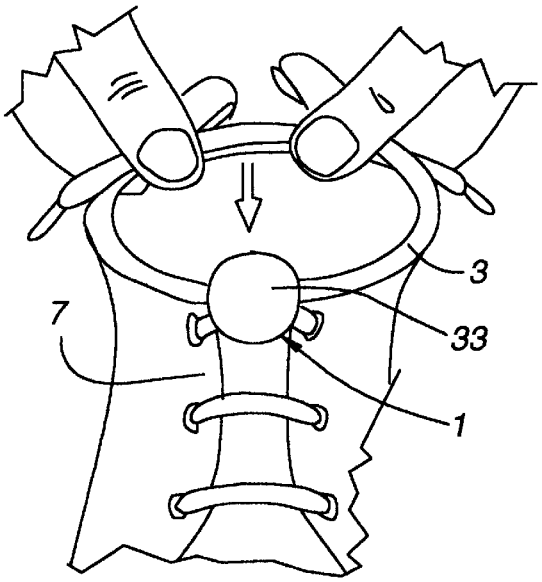
FIG. 24 is a schematic view showing the shoe lace in a tightened condition but prior to formation of a bow.
Figure 15:
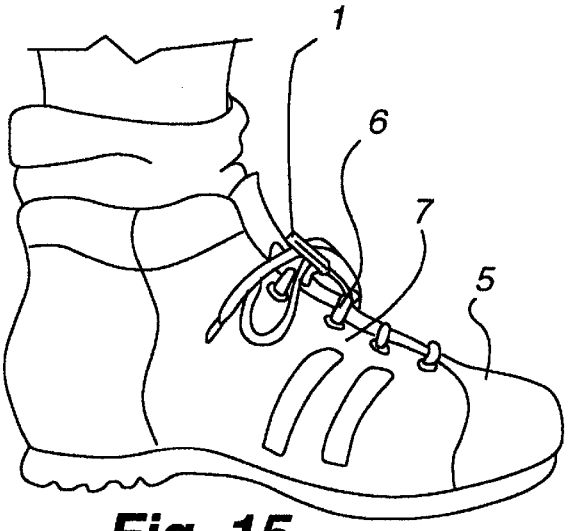
FIG. 15 is a side elevational view of the arrangement shown in FIG. 14.
Figure 16:
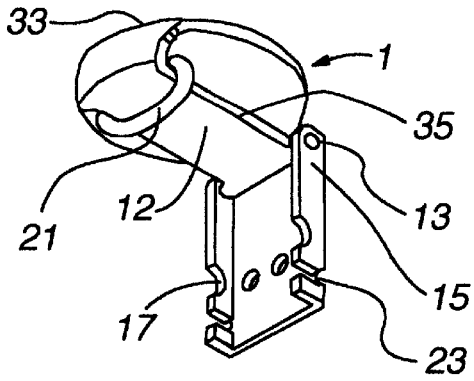
FIG. 16 is a side elevational view of the fastening device according to the second embodiment with the first and second members swung apart.
Figure 17:
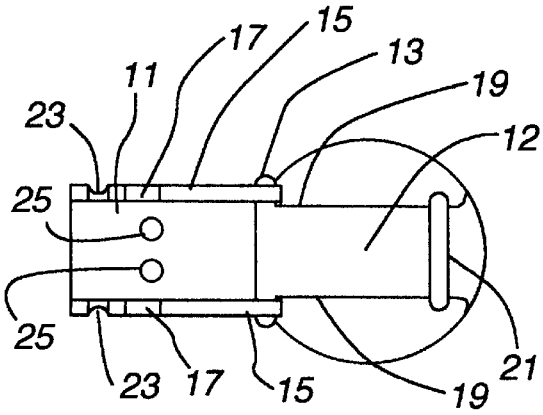
FIG. 17 is a view of the underside of the fastening means as shown in FIG. 16.

Alternatively, once the shoe lace has been tightened sufficiently as shown in FIG. 12, the shoe may be worn in this way as shown in FIG. 13. In this form, there is no need to insert the lace ends in the wedge 35 to make a bow which presents an easy method of securing laces for young children or persons who have difficulty tying laces. If the lace ends are too long they may be cut and knotted as shown in FIG. 13.

The device according to the second embodiment as shown in FIGS. 14 to 23, is similar in many respects to the device of the first embodiment. However, in the second embodiment the first member 11 and the second member 12 are pivotally connected together by a hinge 13 for movement towards and away from each other. In addition, the first member 11 has a pair of opposed upturned edges 15 which are spaced apart a distance greater than the width of the second member 12 such that the second member can pivot towards the first member and be received within the region between the upturned edges 15.

Figure 23:
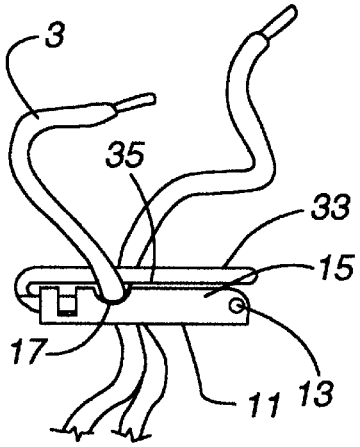
FIG. 23 is a side view of the fastening device in the position shown in FIG. 22.
Figure 18:
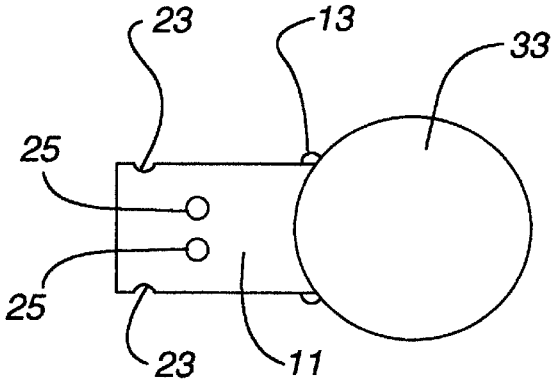
FIG. 18 is a plan view of the fastening device as shown in FIG. 16.
Figure 21:
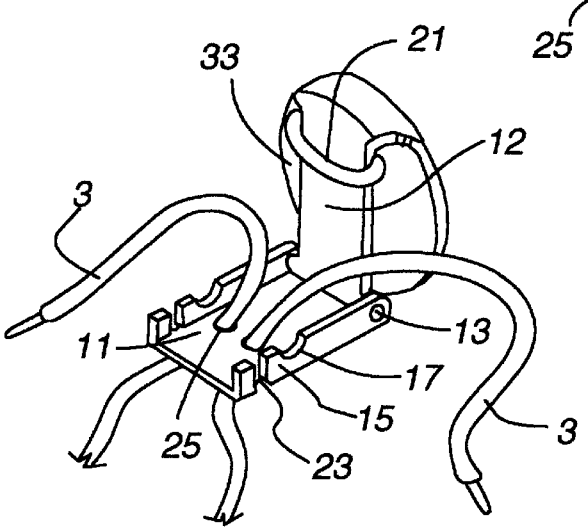
FIG. 21 is a detailed view of FIG. 20.

In the second embodiment, each upturned edge 15 of the first member is provided with a recess 17 which receives one of the lace ends of the shoe lace as shown in FIG. 23. The upturned edge 15 of each first member cooperates with the corresponding edge 19 of the second member to define a clamping unit for gripping one of the lace ends as will be explained later.

Figure 19:
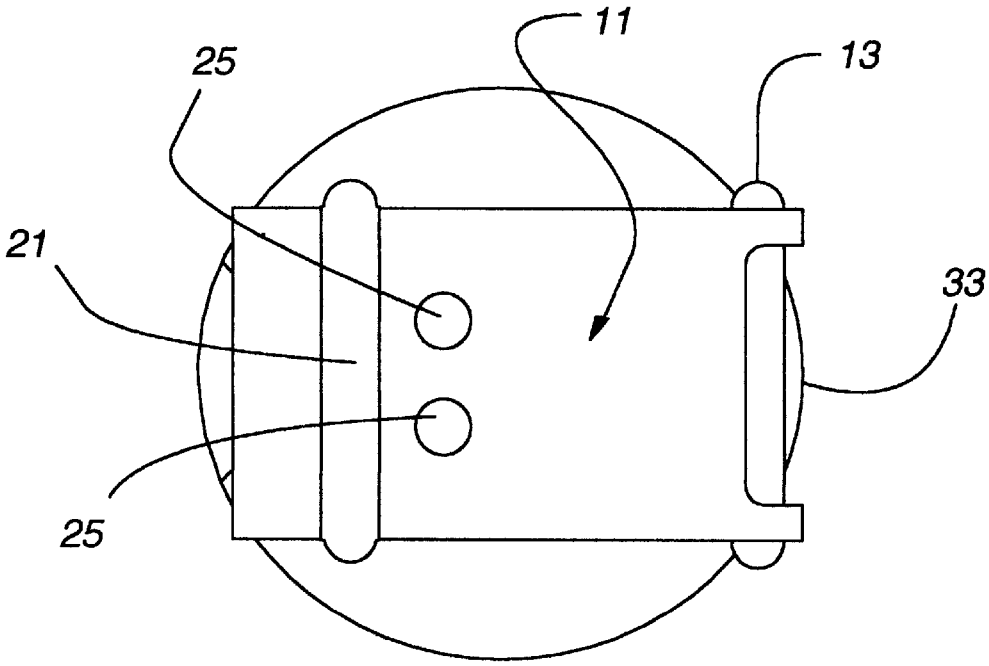
FIG. 19 is an underside view of the fastening device according to the second embodiment with the first and second members elastically connected together.

A biasing means 21 is provided for selectively urging the first and second members 11 and 12 towards each other whereby the second member is received between the upturned edges 15 of the first member. As in the case of the first embodiment, the biasing means 21 is in the form of an elastic band which extends around the second member 12 and is adapted to be secured to the first member 11 adjacent the free end thereof. For this purpose, the first member 11 is provided with a groove 23 in each of the edges 15 to receive and locate the elastic band when it is passed around the first member, as best seen in FIGS. 19 and 22.

As in the case of the first embodiment, the holding means comprises an outer member 33 which cooperates with the second member 12 to define a wedge 35 into which the lace ends are inserted. While the outer member may be of any suitable configuration, in this embodiment it is generally circular and is coloured for decorative purposes.

Figure 22:
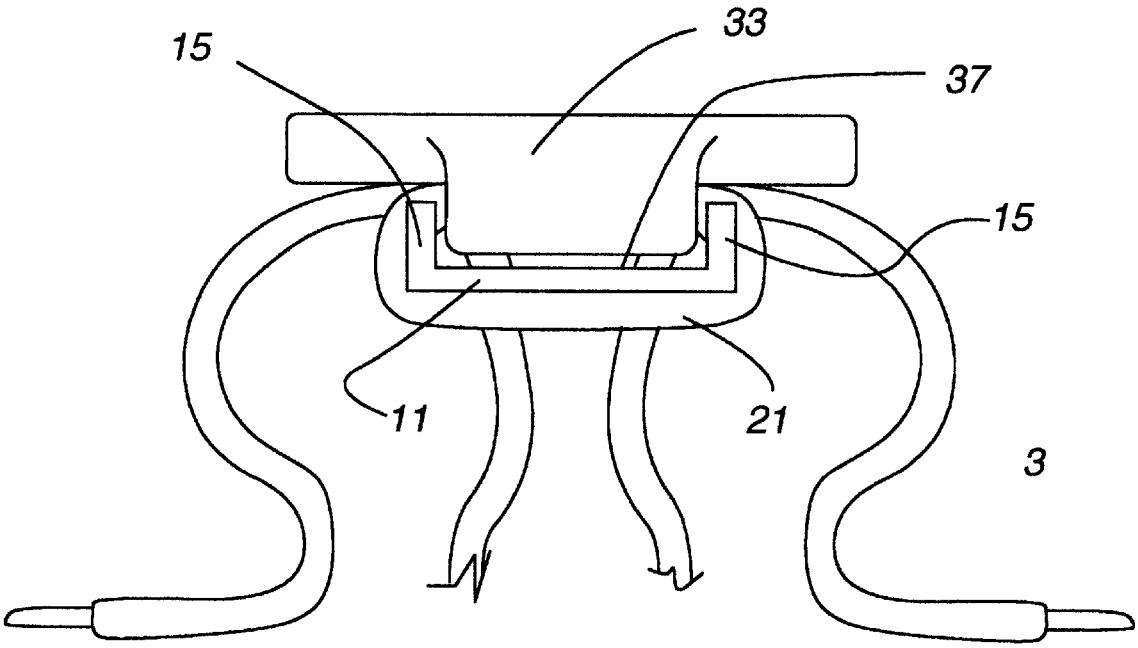
FIG. 22 is a schematic view illustrating the fastening device according to the second embodiment being fitted onto the ends of the shoe lace with the first and second members elastically connected together.

The operation of the device according to the second embodiment is similar in many ways to that of the first except that once the lace ends 3 have been threaded through each hole 25, the lace ends are then laid in opposite directions such that each locates in one of the recesses 17 as shown in FIG. 22 of the drawings. As described previously, the second member is pivoted towards the first member and the elastic band 21 is engaged with the first member in the grooves 23. The positioning of the lace ends in the recesses 17 and the cooperation of the upturned edge 15 with the corresponding edge 19 of the second member assist in preventing reverse movement of the lace ends.

The device according to the third embodiment, as shown in FIGS. 26 to 32, is similar in many respects to the devices of the first and second embodiments. The device of the third embodiment comprises a first member 11 and a second member 12 both formed integrally of plastics material pivotally connected together by a film hinge 14. The device of the third embodiment differs from that of the other two embodiments in that the first member 11 is provided with elongate projections 16 to assist in clamping the lace ends on operations of the device. As can be best seen in FIGS. 26 and 27, the first member 11 has a pair of opposed projections 16 which are spaced apart a distance greater than the width of the second member 12 such that the second member can pivot towards the first member and be received within the region between the projections 16. The projections 16 may be moulded to the first member 11 or may be affixed to the first member as separate portions made of a suitable material.

Figure 30:
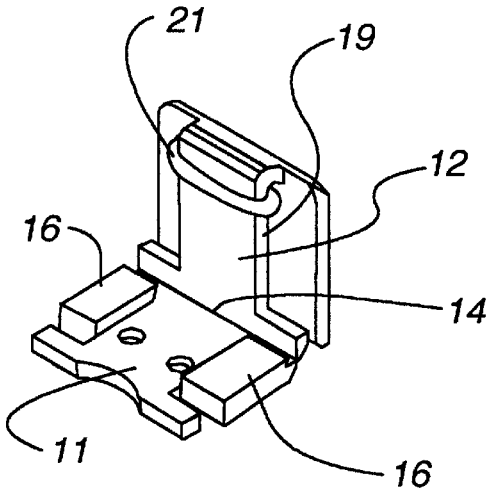
FIG. 30 is a perspective view of the fastening device according to the third embodiment with the first and second members swung apart.
Figure 31:
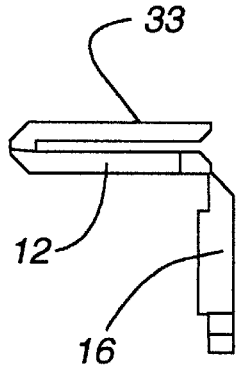
FIG. 31 is a schematic side elevational view of the fastening device according to the third embodiment with the first and second members swung apart.
Figure 25:
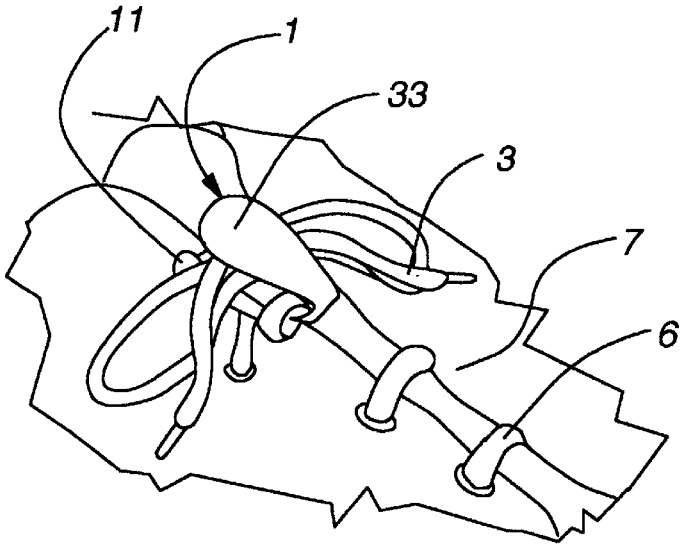
FIG. 25 is a view similar to FIG. 23 with the exception that the fastening device is now shown in a condition where it forms a bow in the shoe lace.
Figure 32:
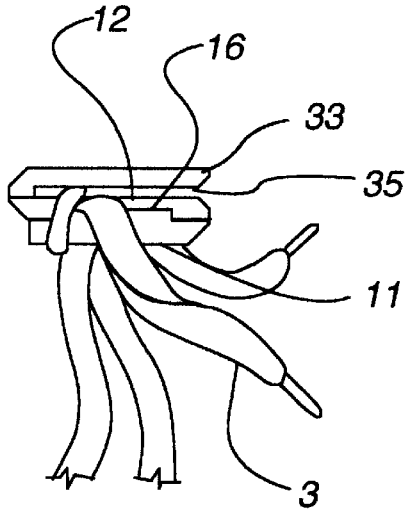
FIG. 32 is a side view showing the fastening device according to the third embodiment being fitted onto the ends of a shoe lace with the first and second members elastically connected together.
Figure 26:
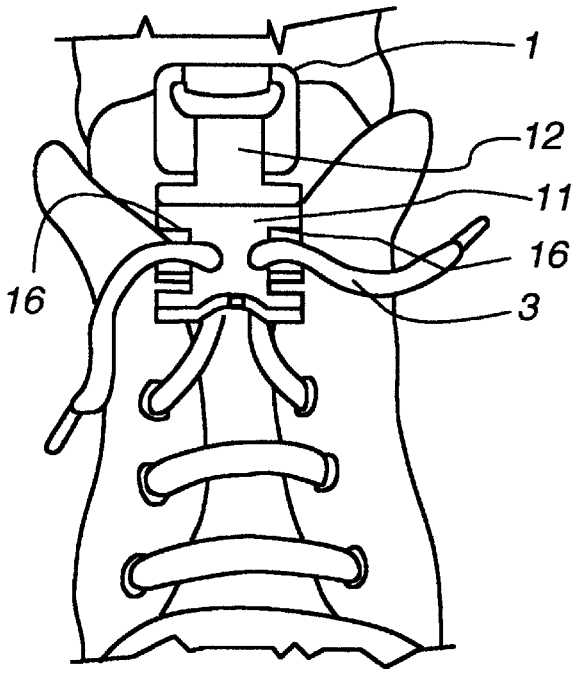
FIG. 26 is a schematic view illustrating the fastening device according to the third embodiment being fitted onto the ends of the shoe lace prior to the first and second members being elastically connected together.
Figure 28:
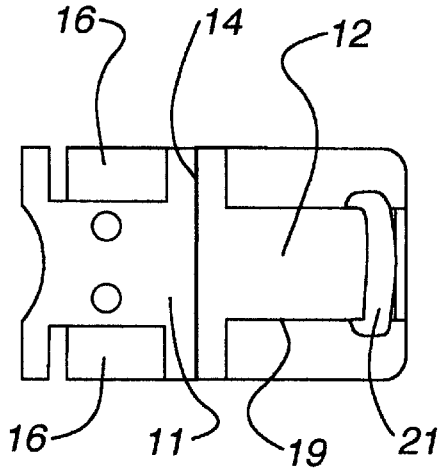
FIG. 28 is a view of the fastening device according to the third embodiment with the first and second members swung apart in particular to illustrate the elongate projections on the first member.
Figure 27:
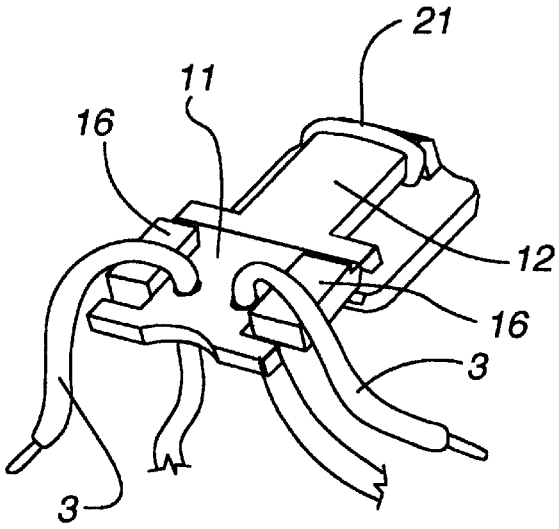
FIG. 27 is a detailed view of FIG. 26.
Figure 29:
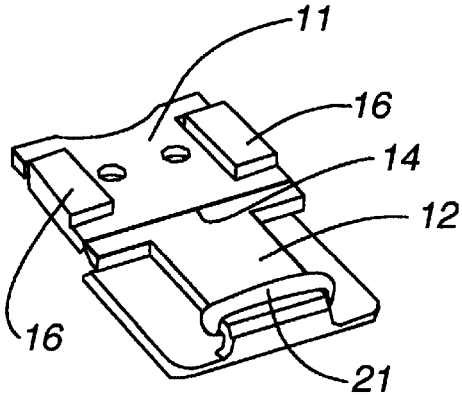
FIG. 29 is a plan view of the fastening device according to the third embodiment with the first and second members swung apart.

The projection 16 of each first member cooperates with the corresponding edge 19 of the second member to define a clamping unit for gripping one of the lace ends as can be seen in FIGS. 30 and 32. This clamping effect assists in inhibiting movement of the lace end in a reverse direction.

The device according to the first and third embodiments allows for ease of manufacture because of its plastic construction, presence of the film hinge, and the substantially planar first member.

The device of all three embodiments has the advantage that it allows the tightening of laces using only one hand which assists persons with disabilities or persons who only have the use of one hand.

The fastening device retains the lace ends together during any activity normally performed in laced shoes. It at any time the tightness of the lacing requires adjustment, it is merely necessary to remove the lace ends from the wedge 35, carry out the adjustment and then return the lace ends into the wedge in the overlapped arrangement. Where the necessary adjustment involves tightening of the lacing, all that is necessary is to pull on the lace ends after they have been removed from the adjustment and pivot the second member 12 away from the first member against the influence of the elastic band 21 so as to release clamping engagement on the lace ends. The lace ends can then move rearwardly through the fastening device as necessary in order to achieve the necessary adjustment. Thereafter the second member is released so that it returns to its former position under the influence of the elastic band 21, whereupon the lace ends are again clampingly engaged between the first and second members.

When it is desired to remove the shoe from the foot of the wearer, the lace ends are removed from the wedge in the case of the bow form and the second member 12 pivoted away from the first member to permit sufficient loosening of the lacing for removal of the shoe. It should be noted that the fastening device is not removed from the lace ends; it remains in position on the lace ends ready for use on the next occasion that the shoe is worn.

The fastening device not only provides a useful alternative to tying of a bow for securing the ends of the shoe lace together but also may function as a fashion accessory for shoes. In this regard the outer member 33 may be suitably shaped, coloured and otherwise presented for visual appeal.

It should be appreciated that the scope of the invention is not limited to the scope of the embodiments described. In particular it should be appreciated that a biasing means other than an elastic band could be employed to urge the first and second members together. Additionally, it should be appreciated that the fastening device can be used with shoe laces other than flat laces. Where, for example, the fastening device is used with round shoe laces, the laces would preferably be positioned in side by side overlapping relation rather than one upon the other before being inserted into the wedge.

What is claimed is:

1. A fastening device for releasably securing two lace ends together, comprising a body having a space through which the lace ends can pass, and gripping means associated with the space for gripping the lace ends in a manner which allows movement of the lace ends through the space but selectively resists reverse movement, the body including first and second members defining said space therebetween, aperture means provided in the first member through which the lace ends can enter the space, the arrangement being such that in use the lace ends extend in substantially opposite directions within said space and emerge from the space at the periphery thereof, the first and second members defining the gripping means, the first and second members being hingedly connected together for pivotal movement towards and away from each other whereby they can assume an engaging condition in which the gripping means engage the lace ends in a manner which allows movement of the lace ends through the space to emerge from said periphery but prevents movement in the reverse direction, and a release condition in which the gripping means allow movement of the lace ends in the reverse direction and a biasing means operably connected between the first and second members for yieldingly urging the first and second members in the direction towards each other thereby to influence the gripping means into the engaging condition, the biasing means permitting movement of the first and second members between the engaging and release conditions without interrupting the connection that it provides therebetween.

2. A fastening device according to claim 1 wherein the device further comprises a holding means for releasably holding the portion of each lace extending beyond the space.

3. A fastening device according to claim 2 wherein said holding means comprises a wedge provided on said second member.

4. A fastening device according to claim 3 wherein said wedge comprises a pair of inclined faces one of which is defined by said second member.

5. A fastening device according to claim 1 wherein the gripping means comprises two clamping units each adapted to engage one of the lace ends.

6. A fastening device according to claim 5 wherein each clamping unit comprises two clamping jaws, one clamping jaw being defined by the first member and the other clamping jaw being defined by the second member wherein the clamping jaws move between said engaging and release conditions with movement of the first and second members towards and away from each other.

7. A fastening device according to claim 5 wherein each clamping unit comprises a clamping portion adapted to assist in clamping the lace end.

8. A fastening device according to claim 7 wherein each clamping portions is the form of an elongated projection on the first member disposed laterally of the aperture means to opposed sides thereof.

9. A fastening device according to claim 5 wherein said two clamping units are disposed laterally of said aperture means.

10. A fastening device according to claim 5 wherein said two clamping units are disposed adjacent the outer periphery of said space.

11. A fastening device according to claim 1 wherein the biasing means comprises an elastic band attached to one of the first and second members and releasably attachable to the other of the first and second members whereby when so attached the elastic band resiliently resists movement of the first and second members in the direction away from each other.

12. A fastening device according to claim 11 wherein said one of the first and second members comprises the second member and whereby said other of said first or second members comprises the first member.

13. A fastening device according to claim 11 wherein said elastic band is attached to one of said first or second members by being fitted onto said first or second member to extend therearound.

14. A fastening device according to claim 1 wherein said aperture means comprises two apertures each for receiving one of the lace ends.

15. A fastening device according to claim 1 wherein said aperture means are provided centrally within said first member.

16. A fastening device according to claim 1 wherein the body is of one piece construction and the first and second members are pivotally connected together by means of a film hinge integral therewith.

17. The fastening device of claim 1 wherein the biasing means is detachably connected to allow the first and second members to be pivoted apart to remove the fastening device from the lace ends.

18. A fastening device for releasably securing two lace ends together comprising a body having first and second members defining a space therebetween, aperture means provided in the first member and opening onto said space for receiving the lace ends whereby the lace ends can enter said space through the aperture means and extend in substantially opposite directions to emerge at the outer periphery of said space, gripping means having a gripping condition and release condition whereby in said gripping condition the gripping means allow movement of the lace ends from said aperture means through said space to emerge therefrom while resisting movement in the reverse direction and wherein in said release condition said gripping means allows movement of the lace ends in said reverse direction and wherein biasing means are provided for urging the first and second members in the direction towards each other thereby to influence the gripping means into the gripping condition and wherein the biasing means are operably connected between the first and second members of yieldingly urging the first and second members in the direction towards each other thereby to influence the gripping means into the engaging condition, the biasing means permitting movement of the first and second members between the gripping and release conditions without interrupting the connection that it provides therebetween, the biasing means comprising an elastic band attached to one of the first and second members and releasably attachable to the other of the first and second members whereby when so attached the elastic band resiliently resists movement of the first and second members in the direction away from each other.

19. A fastening device according to claim 18 wherein said gripping means is defined by the first and second members.

20. A fasting device according to claim 18 wherein said gripping means comprises two clamping units each adapted to engage one of the lace ends.

21. A fastening device according to claim 20 wherein each clamping unit comprises a clamping portion adapted to assist in clamping the lace end.

22. A fastening device according to claim 20 wherein said clamping units are disposed laterally of said aperture means to opposed sides thereof.

23. A fastening device according to claim 20 wherein said clamping units are located adjacent the outer periphery of said space.

24. A fastening device according to claim 18 wherein said aperture means is disposed centrally within said first member.

25. A fastening device according to claim 18 wherein said aperture means comprises a pair of openings in the first member, each adapted to receive one of the lace ends.

26. A fastening device according to claim 18 wherein the device further comprises holding means for releasably holding the portions of each lace end extending outwardly form said space.

27. A fastening device according to claim 18 wherein the first and second members are pivotally connected.

28. A fastening device according to claim 18 wherein the body is of one piece construction and the first and second members are pivotally connected together by means of a film hinge integral therewith.

29. The fastening device of claim 18 wherein the biasing means is detachably connected to allow the first and second members to be moved apart to remove the fastening device from the lace ends.

30. A fastening device for releasably securing two lace ends together comprising a body having first and second members defining a space therebetween, the body being of one piece construction and the first and second members being pivotally connected together by means of a film hinge integral therewith, aperture means provided in the first member and opening onto said space for receiving the lace ends whereby the lace ends can enter said space through the aperture means and extend in substantially opposite directions to emerge at the outer periphery of said space, gripping means having a gripping condition and release condition whereby in said gripping condition the gripping means allow movement of the lace ends from said aperture means through said space to emerge therefrom while resisting movement in the reverse direction and wherein in said released condition said gripping means allows movement of the lace ends in said reverse direction and wherein biasing means are provided for urging the first and second members in the direction towards each other thereby to influence the gripping means into the gripping condition and wherein the biasing means are operably connected between the first and second members of yieldingly urgin the first and second members in the direction towards each other thereby to influence the gripping means into the engaging condition, the biasing means permitting movement of the first and second members between the gripping and release conditions without interrupting the connection that it provides therebetween, the biasing means comprising an elastic band attached to one of the first and second members and releasably attachable to the other of the first and second members whereby when so attached the elastic band resiliently resists movement of the first and second members in the direction away from each other.

31. A fastening device according to claim 30 wherein the first member is provided with a pair of opposed grooves to receive and retain the elastic band.

32. The fastening device of claim 30 wherein the biasing means is detachably connected to allow the first and second members to be pivoted apart to remove the fastening device from the lace ends.

* * * * *